US012130068B2

(12) United States Patent
Wang et al.

(10) Patent No.: US 12,130,068 B2
(45) Date of Patent: Oct. 29, 2024

(54) REFRIGERATOR

(71) Applicants: QINGDAO HAIER REFRIGERATOR CO., LTD., Shandong (CN); HAIER SMART HOME CO., LTD., Shandong (CN)

(72) Inventors: Jing Wang, Qingdao (CN); Xiaobing Zhu, Qingdao (CN); Dongqiang Cao, Qingdao (CN); Mingliang Jiang, Qingdao (CN); Yuezhen Li, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 448 days.

(21) Appl. No.: 17/434,375

(22) PCT Filed: Feb. 19, 2020

(86) PCT No.: PCT/CN2020/075887
§ 371 (c)(1),
(2) Date: Aug. 26, 2021

(87) PCT Pub. No.: WO2020/173360
PCT Pub. Date: Sep. 3, 2020

(65) Prior Publication Data

US 2022/0154997 A1 May 19, 2022

(30) Foreign Application Priority Data

Feb. 26, 2019 (CN) ..... 201910142766.6

(51) Int. Cl.
*F25D 17/08* (2006.01)
*F25D 17/06* (2006.01)
(Continued)

(52) U.S. Cl.
CPC ..... *F25D 17/08* (2013.01); *F25D 17/065* (2013.01); *F25D 21/04* (2013.01); *F25D 21/14* (2013.01);
(Continued)

(58) Field of Classification Search
CPC ..... F25D 17/08; F25D 17/065; F25D 17/067; F25D 21/04; F25D 21/14; F25D 23/006;
(Continued)

(56) References Cited

U.S. PATENT DOCUMENTS 6,240,739 B1 6/2001 Hayes
6,272,876 B1 * 8/2001 Roberts ..... F25D 17/067 454/193
(Continued)

FOREIGN PATENT DOCUMENTS

CN 104567180 A 4/2015
CN 104641190 A 5/2015
(Continued)

OTHER PUBLICATIONS

WO-2019175965-A1 English Translation (Year: 2019).*
(Continued)

*Primary Examiner* — David J Teitelbaum
*Assistant Examiner* — Devon Moore
(74) *Attorney, Agent, or Firm* — Alston & Bird LLP

(57) ABSTRACT

A refrigerator includes a top cover which separates a storage liner on a bottommost portion into a storage space located on an upper portion and a cooling space located on a lower portion. At least one return air hood is arranged at a front end of the top cover, the cooling space is jointly defined by the return air hood, the top cover and a bottom wall of the storage liner, and an evaporator is arranged in the cooling space. The return air hood includes a return air frame located on a front side and a return air rear cover inserted into the
(Continued)

return air frame from an open rear end of the return air frame. The return air rear cover is arranged to separate a first opening formed in a front wall face of the return air frame into a first front return air inlet located on an upper portion and a second front return air inlet located on a lower portion, so that the visual attractiveness is achieved, and the fingers of children or foreign matter can be effectively prevented from entering the cooling space. In addition, due to two return air areas distributed vertically, return air can flow through the evaporator more evenly after entering the cooling space, the problem that a front end face of the evaporator is prone to frosting can be avoided to a certain degree, the heat exchange efficiency can be improved, the defrosting period can be prolonged, and energy conservation and high efficiency are achieved.

9 Claims, 7 Drawing Sheets

(51) Int. Cl.
*F25D 21/04* (2006.01)
*F25D 21/14* (2006.01)
*F25D 23/00* (2006.01)
*F25D 23/06* (2006.01)

(52) U.S. Cl.
CPC ..... *F25D 23/006* (2013.01); *F25D 23/066* (2013.01); *F25D 2317/063* (2013.01); *F25D 2317/0651* (2013.01); *F25D 2317/067* (2013.01); *F25D 2317/0683* (2013.01)

(58) Field of Classification Search
CPC ..... F25D 23/066; F25D 2317/063; F25D 2317/0651; F25D 2317/067; F25D 2317/0671
See application file for complete search history.

(56) References Cited

U.S. PATENT DOCUMENTS

| | | | | |
|---|---|---|---|---|
| 9,890,984 | B2 | 2/2018 | Kim | |
| 2005/0172654 | A1 | 8/2005 | Rohrer et al. | |
| 2018/0087824 | A1* | 3/2018 | Han | F25D 21/004 |
| 2018/0299182 | A1 | 10/2018 | Besore et al. | |

FOREIGN PATENT DOCUMENTS

| | | | | | |
|---|---|---|---|---|---|
| CN | 105115218 | A | | 12/2015 | |
| CN | 105371564 | A | * | 3/2016 | F25D 17/045 |
| CN | 106839601 | A | | 6/2017 | |
| CN | 108592474 | A | | 9/2018 | |
| CN | 108626941 | A | | 10/2018 | |
| CN | 208475771 | U | | 2/2019 | |
| CN | 110285630 | A | | 9/2019 | |
| CN | 110375493 | A | | 10/2019 | |
| CN | 209893728 | U | | 1/2020 | |
| CN | 209893730 | U | | 1/2020 | |
| CN | 209893737 | U | | 1/2020 | |
| CN | 209893741 | U | | 1/2020 | |
| JP | 2002039663 | A | * | 2/2002 | F25D 11/022 |
| JP | 2015206501 | A | | 11/2015 | |
| WO | WO-2004085938 | A1 | * | 10/2004 | F25D 17/065 |
| WO | WO-2019175965 | A1 | * | 9/2019 | |

OTHER PUBLICATIONS

CN-105371564-A English Translation (Year: 2016).*
JP-2002039663-A English Translation (Year: 2002).*
WO-2004085938-A1 English Translation (Year: 2004).*
Search Report for China Application No. 201910142766.6 dated Feb. 26, 2019 (3 pages).
Office Action for China Application No. 201910142766.6 dated Dec. 18, 2019 (5 pages).
International Search Report for PCT/CN2020/075887 (ISA/CN) mailed Apr. 24, 2020 with English translation (6 pages).
Written Opinion of the International Searching Authority for PCT/CN2020/075887 (ISA/CN) mailed Apr. 24, 2020 with English translation (6 pages).
Supplementary European Search Report for EP Application No. 20763876.8 dated Mar. 23, 2022 (4 pages).
1st Office Action for EP Application No. 20763876.8 dated Apr. 4, 2022 (5 pages).
2nd Office Action for EP Application No. 20763876.8 dated Jul. 21, 2022 (4 pages).
1st Office Action for Australia Application No. 2020227856 dated Jul. 15, 2022 (2 pages).

* cited by examiner

REFRIGERATOR

TECHNICAL FIELD

The present invention relates to the technical field of household appliances, and in particular to a refrigerator.

BACKGROUND ART

In an existing refrigerator, an evaporator is generally positioned at the rear part of a lowermost storage space, which causes that the volume the storage space in a front-rear direction is reduced, the depth of the storage space is limited, and it is inconvenient for the storage space to accommodate the articles which are large in size and not easy to separate.

SUMMARY OF THE INVENTION

In view of the problems above, an objective of the present invention is to provide a refrigerator which solves the problems above or at least partially solves the problems above.

A further objective of the present invention is to improve heat exchange efficiency of return air with an evaporator and facilitate drainage of condensate water.

The present invention provides a refrigerator, including:

a cabinet, including a storage liner located on a bottom-most portion;

a top cover, arranged in the storage liner to separate the storage liner into a storage space located on an upper portion and a cooling space located on a lower portion;

at least one return air hood, arranged at a front end of the top cover, wherein the cooling space is jointly defined by the return air hood, the top cover and a bottom wall of the storage liner; and an evaporator, arranged in the cooling space, and configured to cool an airflow entering the cooling space to form a cooled airflow, wherein the return air hood includes:

a return air frame located on a front side, a first opening being formed in a front wall face of the return air frame, and a rear end of the return air frame being open; and a return air rear cover, inserted into the return air frame from the open rear end of the return air frame, and configured to divide the first opening into a first front return air inlet located on an upper portion and a second front return air inlet located on a lower portion so that return air of the storage space returns to the cooling space via the first front return air inlet and the second front return air inlet.

Optionally, a first return air duct located behind the first front return air inlet is defined between the return air frame and the return air rear cover, and a second opening located behind the first front return air inlet and communicated with the first return air duct is formed in the return air rear cover, so that a return airflow entering via the first front return air inlet enters the cooling space via the second opening; and a second return air duct located behind the second front return air inlet is further defined between the return air frame and the return air rear cover, so that a return airflow entering via the second front return air inlet enters the cooling space via the second return air duct.

Optionally, the return air frame includes a first flow guide inclined section extending backwards and upwards from an upper end of the front wall face of the return air frame and a second flow guide inclined section extending backwards and downwards from a position close to a lower end of the front wall face of the return air frame;

the return air rear cover includes a third flow guide inclined section extending forwards and downwards from back to front, a fourth flow guide inclined section extending forwards and downwards from a lower end of the third flow guide inclined section, a fifth flow guide inclined section extending backwards and downwards from a front end of the fourth flow guide inclined section and a sixth flow guide inclined section extending backwards and downwards from a lower end of the fifth flow guide inclined section;

moreover, the first return air duct is defined by the first flow guide inclined section, the third flow guide inclined section and the fourth flow guide inclined section, and the second opening is formed in the third flow guide inclined section; and the second return air duct is defined by the second flow guide inclined section and the sixth flow guide inclined section.

Optionally, a junction of the fourth flow guide inclined section and the fifth flow guide inclined section is located under the first flow guide inclined section, so that condensate water condensed at the return air frame drips to the junction of the fourth flow guide inclined section and the fifth flow guide inclined section along the first flow guide inclined section, drips to the second flow guide inclined section along the fifth flow guide inclined section, and then flows to a position below the evaporator.

Optionally, a plurality of third openings successively distributed in a transverse direction are formed in the sixth flow guide inclined section, so that a return airflow passing through the second return air duct enters the cooling space via the plurality of third openings.

Optionally, a lower surface of the top cover and an upper surface of the evaporator are spaced apart, and the front end of the top cover is located on an upper rear side of a front end of the evaporator, so that the top cover does not completely shield the upper surface of the evaporator;

the return air rear cover further includes a shielding portion extending backwards and upwards from the third flow guide inclined section to the front end of the top cover so as to shield a section of the upper surface of the evaporator that is not shielded by the top cover; and the shielding portion and the upper surface of the evaporator are spaced from each other to form an airflow bypass communicated with the second opening, so that at least part of a return airflow entering via the second opening enters the evaporator via the airflow bypass to be cooled by the evaporator.

Optionally, the bottom wall of the storage liner includes a water receiving section formed below the evaporator;

a projection of the water receiving section on a vertical surface parallel to a side wall of the storage liner includes a front flow guide inclined section located on a front side and extending backwards and downwards, a horizontal straight section horizontally extending backwards from the front flow guide inclined section and a rear flow guide inclined section extending backwards and upwards from a rear end of the horizontal straight section; and a water outlet is formed in the horizontal straight section, to discharge the condensate water.

Optionally, there are two return air hoods and the two return air hoods are transversely distributed at an interval.

Optionally, the refrigerator further includes:

a vertical beam, arranged between the two return air hoods, and vertically extending upwards to a top wall of the storage liner to separate a front side of the storage liner into two areas distributed transversely.

Optionally, the refrigerator further includes:

an air supply duct, arranged on an inner side of a rear wall of the storage liner, communicated with the cooling space, and configured to deliver at least part of the cooled airflow into the storage space; and an air blower, located behind the evaporator, wherein an air outlet end of the air blower is connected with an air inlet end of the air supply duct, and the air blower is configured to promote the cooled airflow to enter the air supply duct.

Optionally, the storage liner is a freezing liner, and the storage space is a freezing space;

the refrigerator further includes:

a variable temperature liner, located over the storage liner, wherein a variable temperature space is defined in the variable temperature liner; and a refrigeration liner, located over the variable temperature liner, wherein a refrigeration space is defined in the refrigeration liner.

According to the refrigerator of the present invention, the bottommost space of the refrigerator is the cooling space, the height of the storage space located above the cooling space is increased, the stooping degree of a user when the user takes and places articles in the storage space is reduced, and the use experience of the user is improved. In addition, two return air inlets which are distributed vertically are formed in the front side of the return air hood, thus, the visual attractiveness is achieved, and furthermore, fingers of children or foreign matters can be effectively prevented from entering the cooling space. Moreover, two return air areas distributed vertically enable return air to flow through the evaporator more evenly after entering the cooling space, the problem that the front end face of the evaporator is easily frosted can be avoided to a certain degree, the heat exchange efficiency can be improved, the defrosting period can be prolonged, and energy conservation and high efficiency are achieved.

Further, in the refrigerator of the present invention, designed structures of all the inclined sections of the return air frame and designed structures of all the inclined sections of the return air rear cover can guide flow of the condensate water formed on the return air hood, water drainage is facilitated, sound of water drops perceptible to human ears can be avoided, and the use experience of the user is improved.

Furthermore, in the refrigerator of the present invention, an airflow bypass is defined among the shielding portion of the return air rear cover, the top cover and the upper surface of the evaporator, it ensures that even if the front end face of the evaporator is frosted, return air still enters the evaporator to exchange heat with the evaporator, so that the refrigerating effect of the evaporator is guaranteed, the problem that the refrigerating effect of an existing refrigerator is reduced due to the fact that the front end face of the evaporator is frosted is solved, and the refrigerating performance of the refrigerator is improved.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION OF THE INVENTION

The present embodiment provides a refrigerator 100, which is described below with reference to FIG. 1 to FIG. 10. In the following description, orientation or positional relationships indicated by "front", "rear", "upper", "lower", "transverse" and the like are orientations based on the refrigerator 100 itself, "front" and "rear" are directions as indicated in FIG. 1, and "transverse" refers to a direction parallel to a width direction of the refrigerator 100 as shown in FIG. 2.

Figure 1:
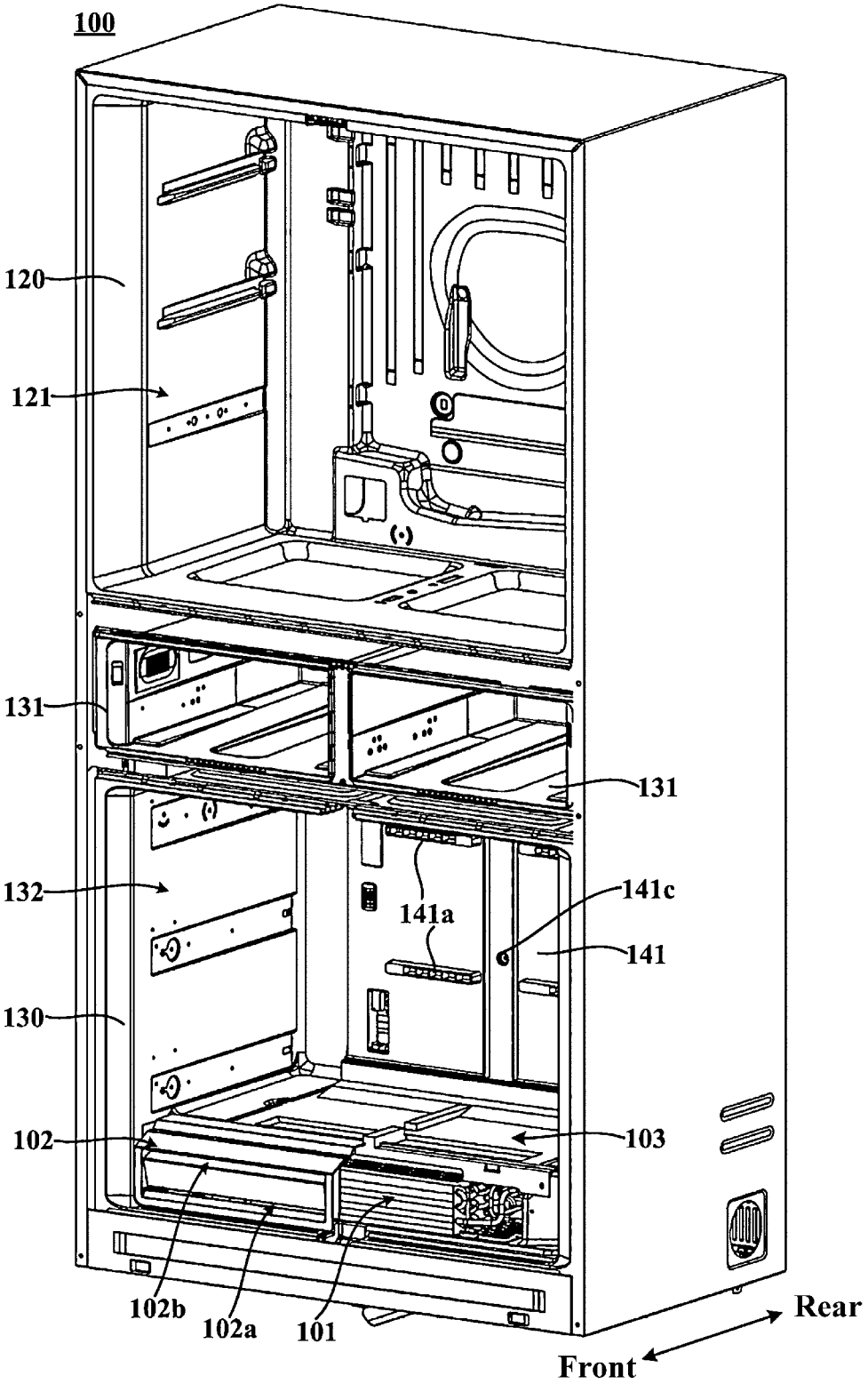
FIG. 1 is a schematic structural view of a refrigerator according to one embodiment of the present invention.
Figure 2:
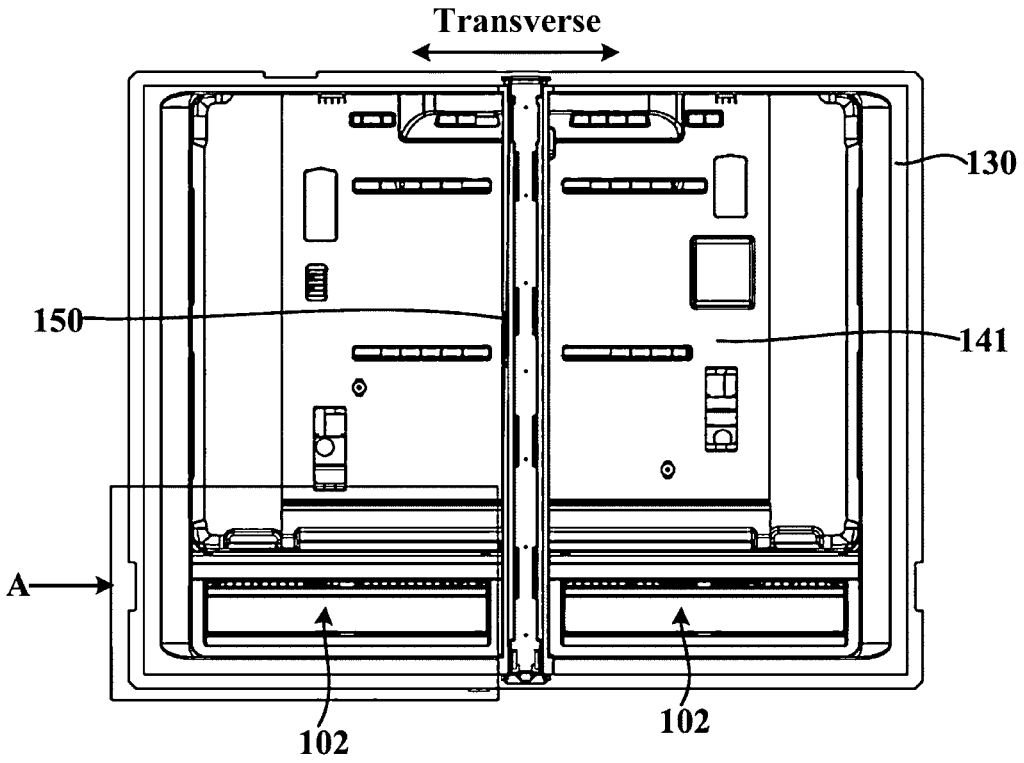
FIG. 2 is a front view of a refrigerator after components such as a storage liner, an air supply duct, return air hoods and a top cover are assembled according to one embodiment of the present invention.

As shown in FIG. 1, the refrigerator 100 may generally include a cabinet. The cabinet includes a shell and at least one storage liner arranged on an inner side of the shell, a space between the shell and the storage liners is filled with a heat-insulation material (forming a foamed layer), a storage space is defined in each storage liner, and a corresponding door body is further arranged on a front side of each storage liner to open or close the corresponding storage space.

The storage liner 130 located on a bottommost portion may be a freezing liner, and correspondingly, the storage space 132 is a freezing space. As shown in FIG. 1, a plurality of storage liners are arranged and respectively include the storage liner 130 located on the bottommost portion, two transversely distributed variable temperature liners 131 located over the storage liner 130 and a refrigeration liner 120 located over the two variable temperature liners 131. A variable temperature space is defined in each variable temperature liner 131, and a refrigeration space 121 is defined in the refrigeration liner 120.

As is well known to those skilled in the art, the temperature of the interior of the refrigeration space 121 is generally between 2° C. and 10° C., preferably between 4° C. and 7° C. The temperature of the interior of the freezing space generally ranges from −22° C. to −14° C. The variable temperature space may be adjusted to −18° C. to 8° C. at will. The optimum storage temperatures for different types of articles are different, and the different types of articles are suitable for being stored at different positions. For example, fruit and vegetable foods are suitable for being stored in the refrigeration space 121, while meat foods are suitable for being stored in the freezing space.

As can be appreciated by those skilled in the art, the refrigerator 100 of the present embodiment may further include an evaporator 101, an air blower 104, a compressor (not shown), a condenser (not shown), a throttling element (not shown) and the like. The evaporator 101 is connected to the compressor, the condenser and the throttling element through a refrigerant pipeline to form a refrigeration cycle loop. The evaporator cools down when the compressor is started, so that air passing through the evaporator is cooled.

Particularly, in the present embodiment, the refrigerator 100 further includes a top cover 103 which is configured to separate the storage liner 130 located on the bottommost portion into a storage space 132 located on an upper portion and a cooling space located on a lower portion, and the evaporator 101 is arranged in the cooling space.

In a conventional refrigerator 100, the bottommost space of the refrigerator 100 is generally a storage space, the storage space is located at a lower position, and a user needs to bend down or squat down greatly to take and place articles in the bottommost storage space, and so it is inconvenient for the user to use and especially inconvenient for the eldly to use. Moreover, the evaporator occupies the rear area of the bottommost storage space, so that the depth of the bottommost storage space is reduced. Besides, a compressor chamber is generally positioned behind the bottommost storage space, the bottommost storage space inevitably needs to leave a space for the compressor chamber, thus, the bottommost storage space is special-shaped, which is inconvenient for storage of articles which are large in size and difficult to separate.

In the refrigerator 100 of the present embodiment, the bottommost space of the refrigerator 100 is a cooling space, so that the height of the storage space 132 above the cooling space is increased, the stooping degree of the user when the user takes and places articles in the storage space 132 is reduced, and the use experience of the user is improved. In addition, the depth of the storage space 132 is guaranteed. Moreover, the compressor chamber may be located on a lower rear side of the storage space 132, and the storage space 132 does not need to leave a space for the compressor chamber, and presents a rectangular space with a large size and a regular shape, so that the articles which are large in size and difficult to separate can be stored conveniently, and the problem that large articles cannot be placed in the storage space 132 is solved.

The evaporator 101 cools an airflow entering the cooling space to form a cooled airflow, at least part of the cooled airflow is delivered into the storage space 132 via an air supply duct 141, the air supply duct 141 may be arranged on an inner side of a rear wall of the storage liner 130 and communicated with the cooling space, as shown in FIG. 1, a plurality of air supply outlets 141*a* communicated with the storage space 132 are formed in the air supply duct 141.

The refrigerator 100 further includes a variable temperature air duct (not shown) for delivering the cooled airflow to the variable temperature space, the variable temperature air duct may be in controlled communication with the air supply duct 141 via a variable temperature damper (not shown) so as to guide part of the cooled airflow in the air supply duct 141 into the variable temperature air duct.

The refrigerator 100 may further include a refrigeration air duct (not shown) which delivers the cooled airflow to the refrigeration space, and the refrigeration air duct may be in controlled communication with the air supply duct 141 via a refrigeration damper to guide part of the cooled airflow of the air supply duct 141 into the refrigeration air duct. In some alternative embodiments, another evaporator may be arranged in the refrigeration liner 120 to cool the refrigeration space 121 by air cooling or direct cooling to form a refrigerator 100 with double refrigerating systems, thus preventing tainting of odor between the storage space 132 and the refrigeration space 121.

Figure 9:
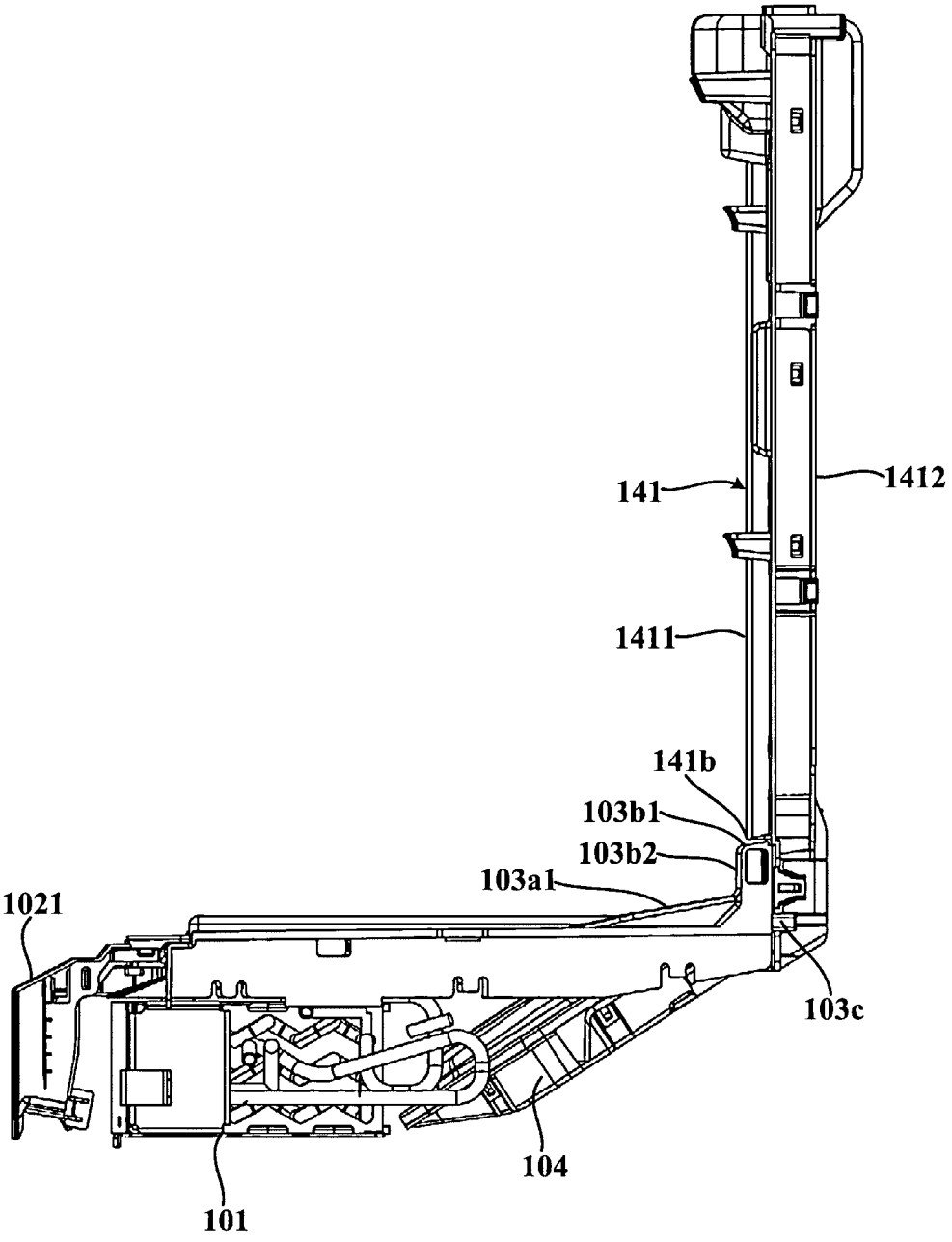
FIG. 9 is a side view of a refrigerator after an air supply duct, return air hoods, a top cover, an evaporator and an air blower are assembled according to one embodiment of the present invention.

In some embodiments, as shown in FIG. 9, the air blower 104 is located at the rear of the evaporator 101, the air outlet end of the air blower is connected with the air inlet end of the air supply duct 141, and the air blower is configured to promote the cooled airflow to enter the air supply duct 141 so as to accelerate airflow circulation and increase the refrigerating speed. The air blower 104 may be a centrifugal fan, an axial-flow fan or a cross-flow fan. As shown in FIG. 9, in the present embodiment, the air blower 104 is a centrifugal fan, and the air blower 104 is arranged upwards obliquely from front to back, and is detachably connected with the air supply duct 141.

The refrigerator 100 further includes at least one return air hood 102 arranged at the front end of the top cover 103, and the cooling space is jointly defined by the return air hood 102, the top cover 103 and a bottom wall of the storage liner 130.

Each return air hood 102 includes a return air frame 1021 located on a front side and a return air rear cover 1022. A first opening 102*c* is formed in a front wall face of the return air frame 1021, and a rear end of the return air frame 1021 is open. The return air rear cover 1022 is inserted into the return air frame 1021 from the open rear end of the return air frame 1021, and is configured to divide the first opening 102*c* into a first front return air inlet 102*b* located on an upper portion and a second front return air inlet 102*a* located on a lower portion, so as to bring convenience for return air of the storage space 132 to return into the cooling space via the first front return air inlet 102*b* and the second front return air inlet 102*a* to be cooled by the evaporator 101. Thus, airflow circulation is formed between the storage space 132 and the cooling space.

In the present embodiment, two return air inlets (the first front return air inlet 102*b* and the second front return air inlet 102*a*) distributed vertically are formed in the front side of the return air hood 102, the visual attractiveness is achieved, and the fingers of children or foreign matter can be effectively prevented from entering the cooling space. In addition, due to two return air areas distributed vertically, the return air can flow through the evaporator 101 more evenly after entering the cooling space, the problem that the front end face of the evaporator 101 is prone to frosting can be avoided to a certain degree, the heat exchange efficiency can be improved, the defrosting period can be prolonged, and energy conservation and high efficiency are achieved.

Figure 4:
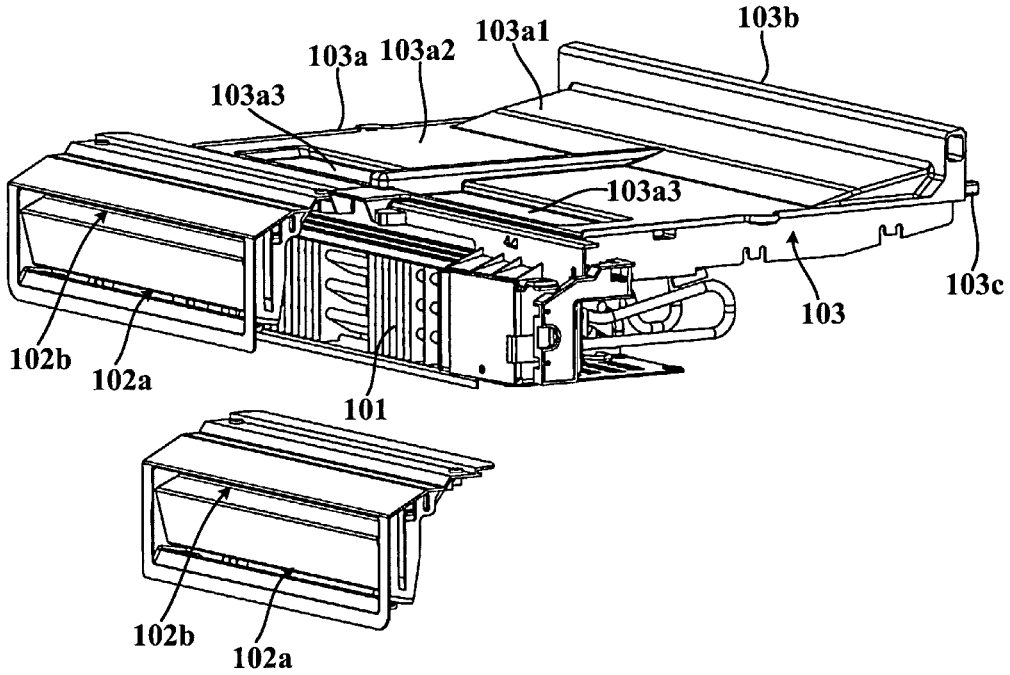
FIG. 4 is a schematic partial exploded view of a refrigerator according to one embodiment of the present invention.

As shown in FIG. 2 and FIG. 4, there are two return air hoods 102, and the two return air hoods 102 are transversely distributed at an interval. A vertical beam 150 is arranged between the two return air hoods 102, and the vertical beam 150 extends vertically upwards to a top wall of the storage liner 130 to separate the front side of the storage liner 130 into two areas distributed transversely.

Two side-by-side door bodies (not shown) may be arranged on the front side of the storage liner 130, and are separately used for opening and closing the two areas separated by the vertical beam 150.

A first return air duct located behind the first front return air inlet 102*b* is defined between the return air frame 1021 and the return air rear cover 1022, and a second opening 102*d* which is located behind the first front return air inlet 102*b* and communicated with the first return air duct is formed in the return air rear cover 1022, so that return air entering via the first front return air inlet 102*b* enters the cooling space via the second opening 102*d*. A second return air duct located behind the second front return air inlet 102*a* is further defined between the return air frame 1021 and the return air rear cover 1022, so that a return airflow entering via the second front return air inlet 102*a* enters the cooling space via the second return air duct.

Figure 5:
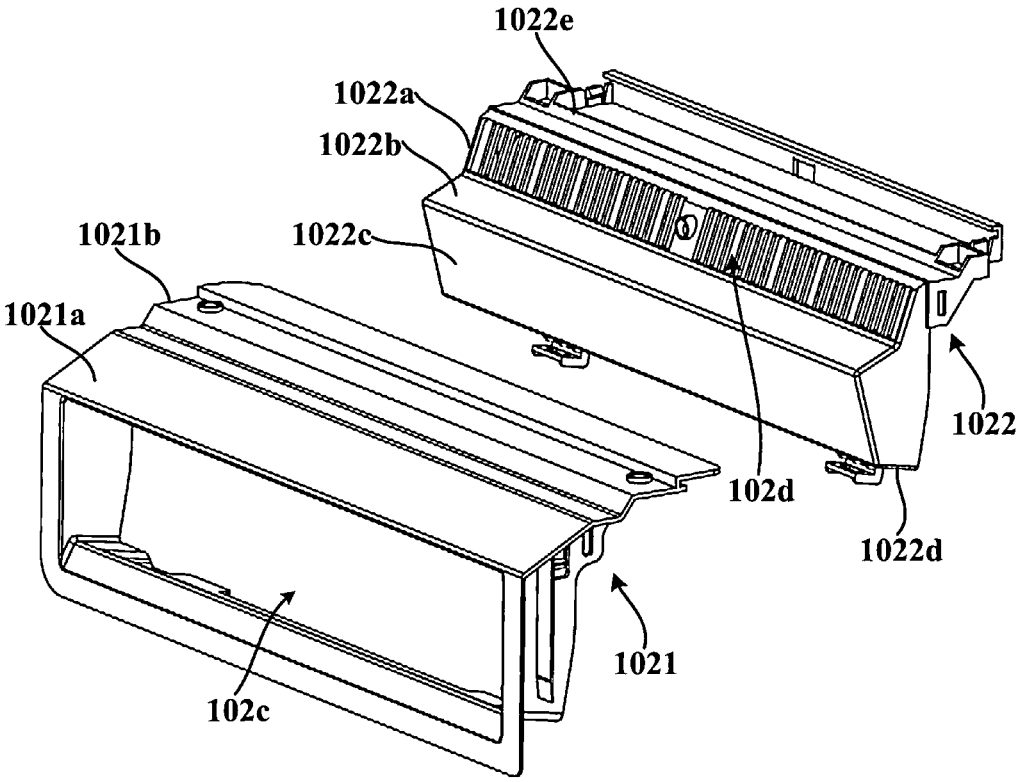
FIG. 5 is a schematic exploded view of a return air frame and a return air rear cover of a refrigerator according to one embodiment of the present invention.
Figure 6:
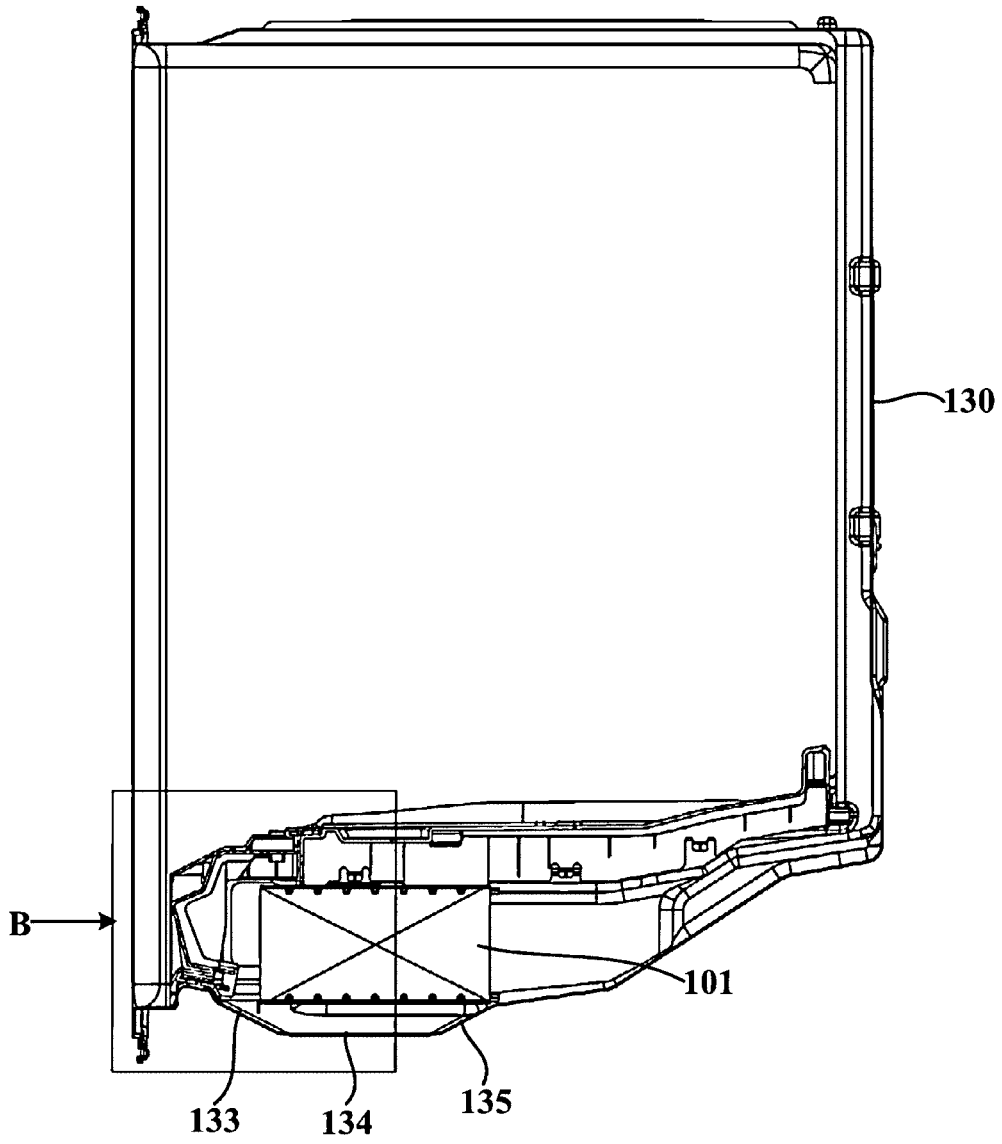
FIG. 6 is a partial sectional view of a refrigerator according to one embodiment of the present invention.
Figure 7:
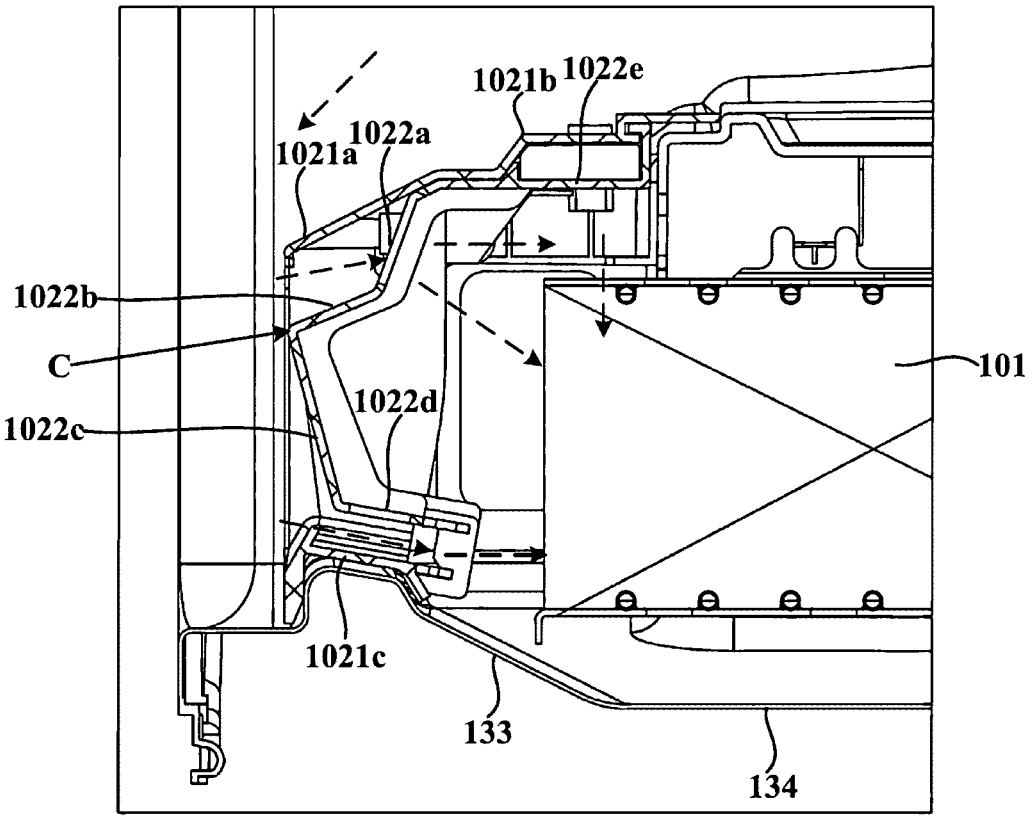
FIG. 7 is an enlarged view of a region B in FIG. 6.

Particularly, as shown in FIG. 5 to FIG. 7, the return air frame 1021 includes a first flow guide inclined section 1021*a* extending backwards and upwards from an upper end of the front wall face of the return air frame 1021 and a second flow guide inclined section 1021*c* extending backwards and downwards from a position close to a lower end of the front wall face of the return air frame 1021. The return air rear cover 1022 includes a third flow guide inclined section 1022*a* extending forwards and downwards from back to front, a fourth flow guide inclined section 1022*b* extending forwards and downwards from a lower end of the third flow guide inclined section 1022*a*, a fifth flow guide inclined section 1022*c* extending backwards and downwards from a front end of the fourth flow guide inclined section 1022*b* and a sixth flow guide inclined section 1022*d* extending backwards and downwards from a lower end of the fifth flow guide inclined section 1022*c*.

Referring to FIG. 7, the first return air duct is defined by the first flow guide inclined section 1021*a*, the third flow guide inclined section 1022*a* and the fourth flow guide inclined section 1022*b*. The second opening 102*d* is formed in the third flow guide inclined section 1022*a*. For example, a plurality of second openings 102*d* which are successively distributed in the transverse direction are formed in the third flow guide inclined section 1022*a*. Return air entering via the first front return air inlet 102*b* enters the cooling space via the first return air duct and the second openings 102*d*, and enters the evaporator 101 from the upper section of the evaporator 101 to be in heat exchange with the evaporator 101. The second return air duct is defined by the second flow guide inclined section 1021*c* and the sixth flow guide inclined section 1022*d*. The return air entering via the second front return air inlet 102*a* enters the cooling space via the second return air duct, and enters the evaporator 101 from the lower section of the evaporator 101 to be in heat exchange with the evaporator 101.

As shown in FIG. 7, the dashed arrows in FIG. 7 schematically represent a return air flow path. The return air enters the cooling space via the two return air ducts in an upper position and a lower position respectively, so that the return air more uniformly passes through the evaporator 101, and the heat exchange efficiency is improved. In addition, the design of all the inclined sections of the return air frame 1021 and the design of all the inclined sections of the return air rear cover 1022 guide condensate water condensed on the return air hoods 102, and drainage is facilitated.

As shown in FIG. 5, each second opening 102*d* is in the shape of a vertical strip, the plurality of second openings 102*d* are successively distributed in the transverse direction to scatter the return air, and thus, the return air more uniformly enters the upper section of the evaporator 101.

Figure 8:
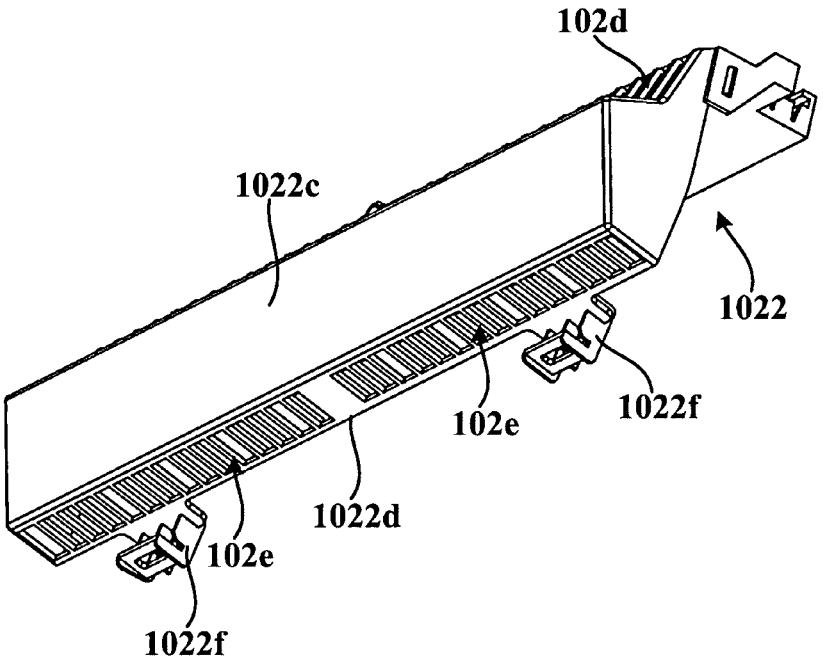
FIG. 8 is a schematic structural view of a return air rear cover of a refrigerator according to one embodiment of the present invention.

As shown in FIG. 8, a plurality of third openings 102*e* which are successively distributed in the transverse direction may be formed in the sixth flow guide inclined section 1022*d*, the return air passing through the second return air duct is distributed by the various third openings 102*e*, and then enters the cooling space, and thus, the return air more uniformly enters the lower section of the evaporator 101.

Mounting portions 1022*f* may be formed on the sixth flow guide inclined section 1022*d*. As shown in FIG. 8, two mounting portions 1022*f* which are transversely distributed at an interval are formed on the sixth flow guide inclined section 1022*d*, correspondingly, matching portions matched with the corresponding mounting portions 1022*f* are formed on the second flow guide inclined section 1021*c* of the return air frame 1021, and thus, the return air frame 1021 and the return air rear cover 1022 are assembled.

As shown in FIG. 4 and referring to FIG. 6 and FIG. 7, a lower surface of the top cover 103 and an upper surface of the evaporator 101 are spaced apart, the front end of the top cover 103 is located on an upper rear side of a front end of the evaporator 101, that is, the top cover 103 does not completely shield the upper surface of the evaporator 101, and a front section of the upper surface of the evaporator 101 is not shielded by the top cover 103.

The return air rear cover 1022 further includes a shielding portion (denoted as a first shielding portion 1022*e*) extending backwards and upwards from the third flow guide inclined section 1022*a* to the front end of the top cover 103, and the first shielding portion 1022*e* is configured to shield the section of the upper surface of the evaporator 101 that is not shielded by the top cover 103. Moreover, the first shielding portion 1022*e* and the upper surface of the evaporator 101 are spaced from each other to form an airflow bypass communicated with the second openings 102*d*, and at least part of return air entering via the second openings 102*d* may enter the evaporator 101 via the airflow bypass from an upper side of the evaporator 101.

A space facing a portion between the top cover 103 and the upper surface of the evaporator 101 is filled with air shielding foam, that is, the rear of the airflow bypass is filled with the air shielding foam, so that all of the return air passing through the airflow bypass flows into the evaporator 101. Thus, it may be ensured that even if the front end face of the evaporator 101 is frosted, return air still enters the evaporator 101 to exchange heat with the evaporator 101, so that the refrigerating effect of the evaporator 101 is guaranteed, the problem that the refrigerating effect of an existing refrigerator 100 is reduced due to the fact that the front end face of the evaporator 101 is frosted is solved, and the refrigerating performance of the refrigerator 100 is improved.

As shown in FIG. 5 and FIG. 7, the return air frame 1021 further includes a second shielding portion 1021*b* bending and extending backwards and upwards from the first flow guide inclined section 1021*a* to the top cover 103, and the second shielding portion 1021*b* completely shields the first shielding portion 1022*e* to keep an attractive appearance of the return air hoods 102.

Further particularly, referring to FIG. 7, a junction C of the fourth flow guide inclined section 1022*b* and the fifth flow guide inclined section 1022*c* is located under the first flow guide inclined section 1021*a*. Condensate water formed on the return air frame 1021 flows downwards along the inclined plane of the first flow guide inclined section 1021*a* and exactly drips onto the junction C of the fourth flow guide inclined section 1022*b* and the fifth flow guide inclined section 1022*c* (namely a corner between the fourth flow guide inclined section 1022*b* and the fifth flow guide inclined section 1022*c*) under the first flow guide inclined section, then drips onto the second flow guide inclined section 1021*c* along the inclined plane of the fifth flow guide inclined section 1022*c*, and then flows to a position below the evaporator 101. A water receiving area is generally arranged below the evaporator 101, a water outlet is formed in the water receiving area, and thus, the condensate water is drained. Accordingly, the condensate water formed on the return air hoods 102 is guided and drained, sound of water drops perceptible to human ears is avoided, and the use experience of the user is improved.

A water receiving section which is located below the evaporator 101 may be formed on the bottom wall of the storage liner 130. A projection of the water receiving section on a vertical surface parallel to a side wall of the storage liner 130 includes a front flow guide inclined section 133 located on a front side and extending backwards and downwards, a horizontal straight section 134 extending horizontally backwards from the front flow guide inclined section 133 and a rear flow guide inclined section 135 extending backwards and upwards from a rear end of the horizontal straight section 134, and a water outlet (not shown) is formed in the horizontal straight section 134. The condensate water formed on the return air hoods 102 is guided by each of the inclined sections of the return air frame 1021 and the return air rear cover 1022, flows to the horizontal straight section 134 along the front flow guide inclined section 133, and is finally drained via the water outlet. The condensate water on the evaporator 101 flows to the horizontal straight section 134 along the front flow guide inclined section 133 and the rear flow guide inclined section 135 respectively, and then is drained via the water outlet.

The water outlet is connected with a water draining pipe (not shown). The condensate water is guided into an evaporation dish of the refrigerator 100 through the water draining pipe. The evaporation dish may generally be located in the compressor chamber, and thus water in the evaporation dish can be evaporated by heat of a condenser and/or a compressor arranged in the compressor chamber.

Figure 3:
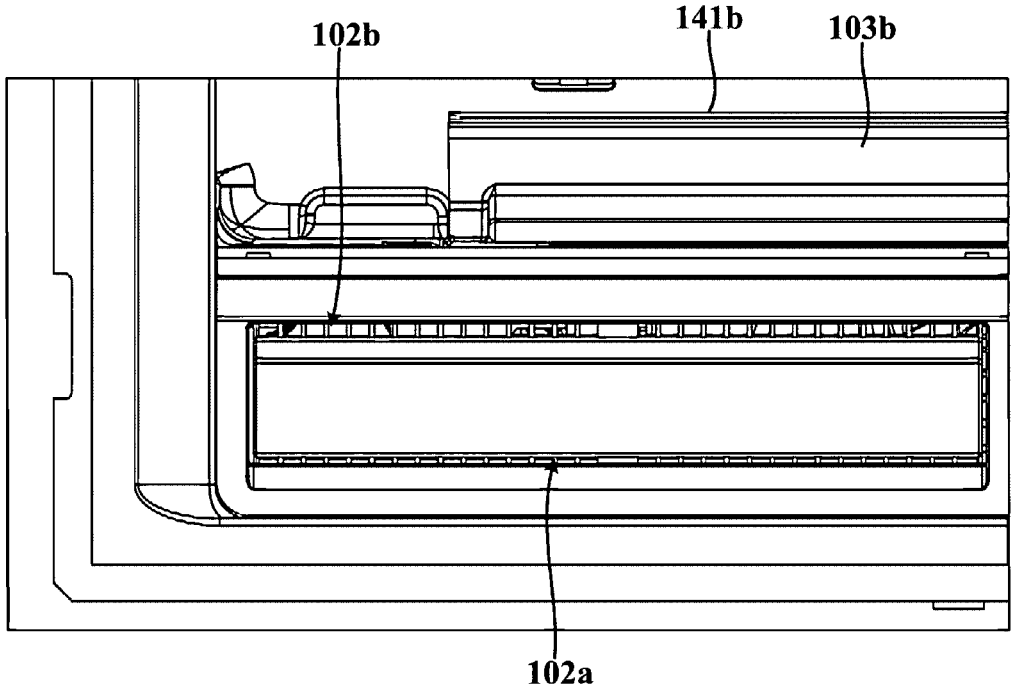
FIG. 3 is an enlarged view of a region A in FIG. 2.

Further particularly, as shown in FIG. 3 and in conjunction with FIG. 9, the top cover 103 includes a top cover body 103*a* and a supporting portion 103*b* which is protruded upwards from a rear end of the top cover body 103*a*. A bearing portion 141*b* protruded forwards is formed in a front wall face of the air supply duct 141. When the top cover 103 and the air supply duct 141 are assembled, the supporting portion 103*b* supports the bearing portion 141*b*, and thus, the air supply duct 141 is prevented from falling when the refrigerator 100 is collided in a transportation process.

Figure 10:
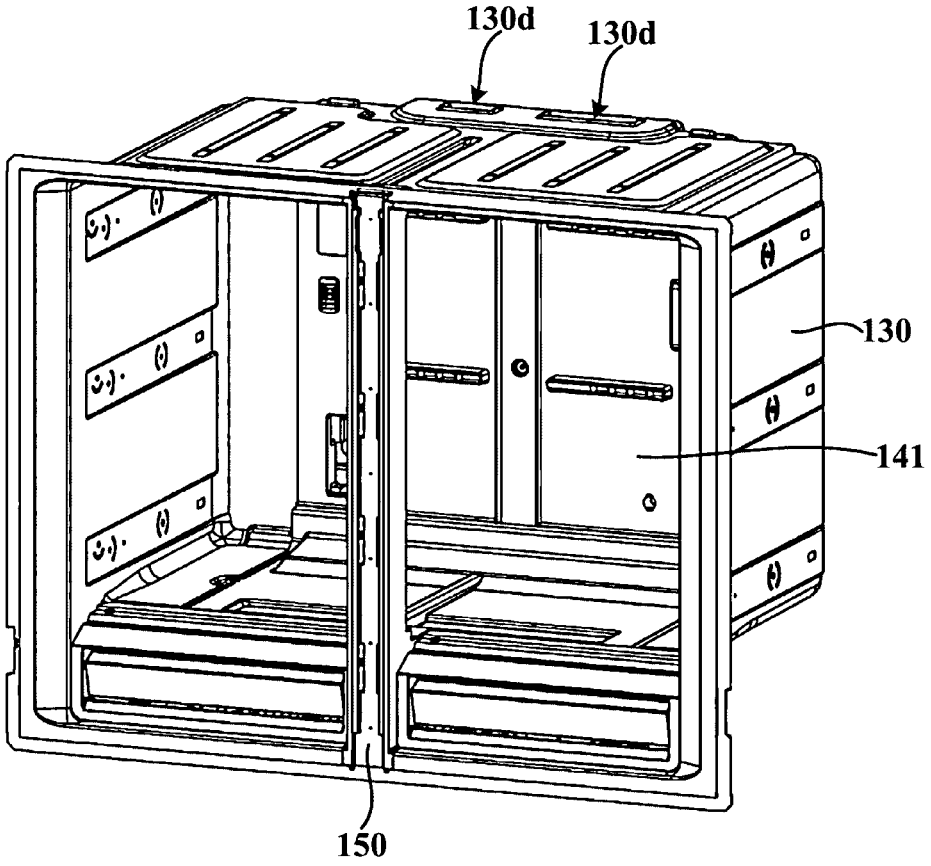
FIG. 10 is a schematic perspective view of a refrigerator after components such as a storage liner, an air supply duct, return air hoods and a top cover are assembled according to one embodiment of the present invention.

A top end of the air supply duct 141 generally penetrates through the top wall of the storage liner 130 to be communicated with an air duct supplying air to other storage spaces (such as a variable temperature air duct (not shown) supplying air to the variable temperature space above the bottommost storage liner 130). Specifically, first top openings (not shown) are formed in the top end of the air supply duct 141, as shown in FIG. 10, second top openings 130*d* which are in one-to-one correspondence to the first top openings are formed in the top wall of the storage liner 130, so that the first top openings are communicated with the air inlet of the variable temperature air duct via the second top openings 130*d*.

A damper may be arranged at each first top opening of the air supply duct 141 to open and close the first top opening in a controlled manner. As shown in FIG. 1, two variable temperature liners 131 are arranged, correspondingly, two variable temperature air ducts are arranged, and two first top openings and two second top openings 130*d* are formed.

In the transportation process of the refrigerator 100, the refrigerator 100 is inevitably collided, which easily causes the air supply duct 141 to fall. Once the air supply duct 141 falls, a gap is formed between the first top openings in the top end of the air supply duct 141 and the corresponding second top openings in the top wall of the storage liner 130. In the operation process of the refrigerator 100, air is crossed between the variable temperature space and the storage space 132 below the variable temperature space, the temperature of the storage space 132 and the temperature of the variable temperature space are affected, a position nearby the top end of the air supply duct 141 is easily frosted, delivering of the cooled airflow is affected, and the refrigerating effect is reduced.

In the present embodiment, the top cover 103 and the air supply duct 141 are specially designed as above, so that the air supply duct 141 can be prevented from falling under the action of an external force, the air supply duct 141 is mounted more stably, and the refrigerating effect of the refrigerator 100 in the operation process can be ensured.

As shown in FIG. 9, the air supply duct 141 includes a duct front cover plate 1411 and a duct rear cover plate 1412 located on a rear side of the duct front cover plate 1411. Correspondingly, the duct front cover plate 1411 forms the front wall face of the air supply duct 141. That is, the bearing portion 141*b* is formed on the duct front cover plate 1411. A channel communicated with the cooling space is defined by the duct front cover plate 1411 and the duct rear cover plate 1412.

The duct front cover plate 1411 and the duct rear cover plate 1412 are fixed by a screw (not shown) penetrating through a center of the air supply duct 141, and as shown in FIG. 1, a screw penetrating hole 141*c* is formed at an approximate center position of the duct front cover plate 1411. A screw post (not shown) is formed at an approximate center position of the duct rear cover plate 1412. The duct front cover plate 1411 and the duct rear cover plate 1412 are locked by matching the screw penetrating through the screw penetrating hole 141*c* with the screw post, and thus, the duct front cover plate 1411 and the duct rear cover plate 1412 are assembled together. By the specially designed structure for preventing the air supply duct 141 from falling, the problem that the duct front cover plate 1411 moves downwards when the screw is loosened is avoided simultaneously.

Further particularly, the bearing portion 141*b* extends downwards obliquely from back to front. An upper end face of the supporting portion 103*b* includes a first inclined section 103*b*1 extending downwards obliquely from back to front. Condensate water may flow forwards and downwards to the top cover body 103*a* along the inclined plane of the bearing portion 141*b* and the inclined plane of the first inclined section 103*b*1.

A front end face of the supporting portion 103*b* may include a vertical section 103*b*2 extending vertically. The vertical section 103*b*2 is connected with the first inclined section 103*b*1 through a first transition curved section. The vertical section 103*b*2 guides condensate water slipping along the first inclined section 103*b*1 to the top cover body 103*a*.

An upper surface of the top cover body 103*a* may include a second inclined section 103*a*1 extending downwards obliquely from back to front. The second inclined section 103*a*1 is connected with the vertical section 103*b*2 through a second transition curved section to further guide the condensate water.

The upper surface of the top cover body 103*a* may further include a horizontal section 103*a*2 extending forwards from a front end of the second inclined section 103*a*1. At least one water collecting trough 103*a*3 is formed in the horizontal section 103*a*2 to collect condensate water flowing down from the second inclined section 103*a*1, and thus, the user can clean the condensate water in a centralized manner. Accordingly, functions of flow guide and drainage are fulfilled by the special structure of the top cover 103. As shown in FIG. 4, two water collecting troughs 103*a*3 which are transversely distributed at an interval are formed in the horizontal section 103*a*2.

During assembling of the refrigerator 100, the duct rear cover plate 1412 is assembled with the air blower 104 at first, the duct front cover plate 1411 is assembled with the air blower 104, and then the top cover 103 is mounted on the storage liner 130. The positions of the duct rear cover plate 1412, the duct front cover plate 1411 and the top cover 103 meet requirements so that the supporting portion 103*b* of the top cover 103 supports the bearing portion of the duct front cover plate 1411.

As shown in FIG. 4 and FIG. 9, positioning protrusions 103*c* protruded backwards are formed at a rear end of the top cover 103. Positioning grooves (not shown) which are in one-to-one correspondence to the positioning protrusions 103*c* and are matched with the positioning protrusions 103*c* are formed in the rear wall of the storage liner 130. Two positioning protrusions 103*c* may be arranged, and the two positioning protrusions 103*c* are separately close to two transverse sides of the rear end of the top cover 103, and are located below the supporting portion 103*b*. Accordingly, the top cover 103 is assembled on the storage liner 130.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from contents disclosed in the present invention. Therefore, the scope of the present invention should be understood and recognized as covering all these other variations or modifications.

The invention claimed is:

1. A refrigerator, comprising:

a cabinet, comprising a storage liner located on a bottom-most portion of the cabinet;

a top cover, arranged in the storage liner to separate the storage liner into a storage space located on an upper portion of the storage liner and a cooling space located on a lower portion of the storage liner;

at least one return air hood, arranged at a front end of the top cover, wherein the cooling space is jointly defined by the return air hood, the top cover and a bottom wall of the storage liner; and an evaporator, arranged in the cooling space, and configured to cool an airflow entering the cooling space to form a cooled airflow, wherein the return air hood comprises:

a return air frame located on a front side of a return air rear cover, a first opening being formed in a front wall face of the return air frame, and a rear end of the return air frame being open; and the return air rear cover, inserted into the return air frame from the open rear end of the return air frame, and configured to divide the first opening into a first front return air inlet located on an upper portion of the return air frame and a second front return air inlet located on a lower portion of the return air frame, so that return air of the storage space returns into the cooling space via the first front return air inlet and the second front return air inlet, wherein a first return air duct located behind the first front return air inlet is defined between the return air frame and the return air rear cover, and a second opening located behind the first front return air inlet and communicated with the first return air duct is formed in the return air rear cover, so that a return airflow entering via the first front return air inlet enters the cooling space via the second opening to be cooled by the evaporator; and a second return air duct located behind the second front return air inlet is further defined between the return air frame and the return air rear cover, so that a return airflow entering via the second front return air inlet enters the cooling space via the second return air duct, the second return air duct being located below and independent from the first return air duct, wherein the return air frame comprises a first flow guide inclined section extending backwards and upwards from an upper end of the front wall face of the return air frame and a second flow guide inclined section extending backwards and downwards from a position adjacent to a lower end of the front wall face of the return air frame;

the return air rear cover comprises a third flow guide inclined section extending forwards and downwards from back to front, a fourth flow guide inclined section extending forwards and downwards from a lower end of the third flow guide inclined section, a fifth flow guide inclined section extending backwards and downwards from a front end of the fourth flow guide inclined section and a sixth flow guide inclined section extending backwards and downwards from a lower end of the fifth flow guide inclined section;

the first return air duct is defined by the first flow guide inclined section, the third flow guide inclined section and the fourth flow guide inclined section, and a second opening is formed in the third flow guide inclined section; and the second return air duct is defined by the second flow guide inclined section and the sixth flow guide inclined section.

2. The refrigerator according to claim 1, wherein a junction of the fourth flow guide inclined section and the fifth flow guide inclined section is located under the first flow guide inclined section, so that condensate water condensed at the return air frame drips to the junction of the fourth flow guide inclined section and the fifth flow guide inclined section along the first flow guide inclined section, drips to the second flow guide inclined section along the fifth flow guide inclined section, and then flows to a position below the evaporator.

3. The refrigerator according to claim 1, wherein a plurality of third openings successively distributed in a transverse direction are formed in the sixth flow guide inclined section, so that a return airflow passing through the second return air duct enters the cooling space via the plurality of third openings.

4. The refrigerator according to claim 1, wherein a lower surface of the top cover and an upper surface of the evaporator are spaced apart, and the front end of the top cover is located on an upper rear side of a front end of the evaporator, so that the top cover does not completely shield the upper surface of the evaporator;

the return air rear cover further comprises a shielding portion extending backwards and upwards from the third flow guide inclined section to the front end of the top cover so as to shield a section of the upper surface of the evaporator that is not shielded by the top cover; and the shielding portion and the upper surface of the evaporator are spaced from each other to form an airflow bypass communicated with the second opening, so that at least part of a return airflow entering via the second opening enters the evaporator via the airflow bypass to be cooled by the evaporator.

5. The refrigerator according to claim 1, wherein the bottom wall of the storage liner comprises a water receiving section located below the evaporator;

a projection of the water receiving section on a vertical surface parallel to a side wall of the storage liner comprises a front flow guide inclined section extending backwards and downwards, a horizontal straight section extending horizontally backwards from the front flow guide inclined section and a rear flow guide inclined section extending backwards and upwards from a rear end of the horizontal straight section; and a water outlet is formed in the horizontal straight section to discharge condensate water.

6. The refrigerator according to claim 1, wherein there are two return air hoods, and the two return air hoods are transversely distributed at an interval.

7. The refrigerator according to claim 6, further comprising:

a vertical beam, arranged between the two return air hoods, and extending vertically upwards to a top wall of the storage liner so as to separate a front side of the storage liner into two areas distributed transversely.

8. The refrigerator according to claim 1, further comprising:

an air supply duct, arranged on an inner side of a rear wall of the storage liner, communicated with the cooling space, and configured to deliver at least part of the cooled airflow into the storage space; and an air blower, located behind the evaporator, wherein an air outlet end of the air blower is connected with an air inlet end of the air supply duct, and the air blower is configured to promote the cooled airflow to enter the air supply duct.

9. The refrigerator according to claim 1, wherein the storage liner is a freezing liner, and the storage space is a freezing space; and the refrigerator further comprises:

a variable temperature liner, located over the storage liner, wherein a variable temperature space is defined in the variable temperature liner; and a refrigeration liner, located over the variable temperature liner, wherein a refrigeration space is defined in the refrigeration liner.

* * * * *